US011270641B1

(12) United States Patent
Lee et al.

(10) Patent No.: US 11,270,641 B1
(45) Date of Patent: Mar. 8, 2022

(54) DISPLAY DEVICE AND DRIVING METHOD THEREOF

(71) Applicant: SAMSUNG DISPLAY CO., LTD., Yongin-si (KR)

(72) Inventors: Dae Sik Lee, Yongin-si (KR); Si Duk Sung, Yongin-si (KR); Sung Mo Yang, Yongin-si (KR); Sang Hyun Lee, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/236,481

(22) Filed: Apr. 21, 2021

(30) Foreign Application Priority Data

Sep. 8, 2020 (KR) ..... 10-2020-0114953

(51) Int. Cl.
*G09G 3/3233* (2016.01)

(52) U.S. Cl.
CPC ... *G09G 3/3233* (2013.01); *G09G 2300/0426* (2013.01); *G09G 2300/0819* (2013.01); *G09G 2300/0842* (2013.01); *G09G 2310/08* (2013.01); *G09G 2320/0257* (2013.01); *G09G 2330/025* (2013.01); *G09G 2330/12* (2013.01)

(58) Field of Classification Search
CPC .... G09G 3/006; G09G 3/3406; G09G 3/3648; G09G 3/3208; G09G 2330/12; G09G 2330/04; G09G 2330/08; G09G 2330/10; G09G 2330/028; G09G 2330/02; G09G 2330/021; G09G 2320/043; G09G 2320/0233
See application file for complete search history.

(56) References Cited

U.S. PATENT DOCUMENTS

| | | | | |
|---|---|---|---|---|
| 8,994,380 | B2 | 3/2015 | Yun et al. | |
| 9,058,773 | B2 | 6/2015 | Park | |
| 10,269,277 | B2 | 4/2019 | Shim | |
| 2008/0203068 | A1* | 8/2008 | Ukai | B23H 1/022 219/69.13 |
| 2013/0328854 | A1* | 12/2013 | Ruan | G09G 3/3696 345/212 |
| 2017/0245379 | A1 | 8/2017 | Kang | |
| 2019/0348836 | A1* | 11/2019 | Wen | H03F 3/45475 |
| 2021/0201792 | A1 | 7/2021 | Lee et al. | |

FOREIGN PATENT DOCUMENTS

| | | |
|---|---|---|
| KR | 10-1535825 | 7/2015 |
| KR | 10-2017-0099421 | 9/2017 |
| KR | 10-2018-0025522 | 3/2018 |
| KR | 10-1860739 | 5/2018 |

* cited by examiner

*Primary Examiner* — Dong Hui Liang
(74) *Attorney, Agent, or Firm* — F. Chau & Associates, LLC

(57) ABSTRACT

A display device includes a first power source, a timing controller, and pixels. The timing controller is connected to the first power source through a main line, an auxiliary line, and a detection line. The pixels are commonly connected to the first power source through a first power line. The first power source includes: a main power source connected to the first power line and the main line; an auxiliary power source connected to the auxiliary line; a rectifier connected between the auxiliary power source and the first power line; and a comparator comparing a voltage of the first power line and providing its output to the detection line.

20 Claims, 7 Drawing Sheets

DISPLAY DEVICE AND DRIVING METHOD THEREOF

CROSS-REFERENCE TO RELATED APPLICATION

This U.S. non-provisional patent application claims priority under 35 U.S.C. § 119(a) to Korean patent application 10-2020-0114953 filed on Sep. 8, 2020 in the Korean Intellectual Property Office, the entire disclosure of which is incorporated by reference in its entirety herein.

1. TECHNICAL FIELD

The present disclosure generally relates to a display device and a driving method thereof.

2. DISCUSSION OF RELATED ART

With the development of information technologies, the importance of a display device used as a communication medium with a user increases. Accordingly, display devices such as a liquid crystal display device and an organic light emitting display device are increasingly used.

A display device displays an image by using a plurality of pixels. The plurality of pixels may be supplied with a driving current from a power source. When a current path of some the pixels is in a short-circuit state, an overcurrent flows, and therefore, a screen burn-in phenomenon may occur.

However, it is difficult to detect an overcurrent flowing through some of the pixels using only a current sensor.

SUMMARY

At least one embodiment of the disclosure provides a display device capable of detecting a minute short-circuit state and a driving method of the display device.

At least embodiment of the disclosure provides a display device capable of preventing an inrush current, which may be generated in an input power source, and a driving method of the display device.

In accordance with an embodiment of the present disclosure, there is provided a display device including a first power source, a timing controller, and a plurality of pixels. The timing controller is connected to the first power source through a main line, an auxiliary line, and a detection line. The plurality of pixels is commonly connected to the first power source through a first power line. The first power source includes: a main power source, an auxiliary power source, a rectifier, and a comparator. The main power source is connected to the first power line and the main line. The auxiliary power source is connected to the auxiliary line. The rectifier is connected between the auxiliary power source and the first power line. The comparator compares a voltage of the first power line and provides its output to the detection line.

The comparator may have an input terminal connected to a reference voltage line.

At a first time, when the timing controller applies an auxiliary signal of an activation level to the auxiliary line, the auxiliary power source may apply a voltage of a first level to the first terminal of the rectifier.

When a voltage of the first power line is higher than a reference voltage of the reference voltage line, the comparator may apply a sensing signal of a detection failure level to the detection line.

At a second time after the first time, when the sensing signal of the detection failure level is received, the timing controller may apply a main signal of an activation level to the main line.

When the main signal of the activation level is received, the main power source may apply a voltage of a second level higher than the first level to the first power line.

When the voltage of the second level is applied to the first power line, the pixels may receive data voltages.

At a third time after the second time, when the timing controller applies the auxiliary signal of an inactivation level to the auxiliary line, the auxiliary power source may suspend supplying a voltage.

The display device may further include a second power source. The pixels may be commonly connected to the second power source through a second power line. The second power line may maintain a voltage level from the first time to the third time.

When the voltage of the first power line is lower than a reference voltage of the reference voltage line, the comparator may apply a sensing signal of a detection success level to the detection line.

At a second time after the first time, when the sensing signal of the detection success level is received, the timing controller may apply a main signal of an inactivation level to the main line.

At the second time, when the sensing signal of the detection success level is received, the timing controller may apply an auxiliary signal of an inactivation level to the auxiliary line.

After the second time, when the main power source receives the main signal of the inactivation level, the first power line may maintain a voltage lower than the reference voltage.

In accordance with an embodiment of the present disclosure, there is provided a method for driving a display device including pixels commonly connected to a first power line. The method includes: applying, by a timing controller, an auxiliary signal of an activation level to an auxiliary line connected to an auxiliary power source, at a first time; applying, by the auxiliary power source, a voltage of a first level to the first power line through a rectifier; applying, by comparator, a sensing signal of a detection failure level to a detection line when a voltage of the first power line is higher than a reference voltage of a reference voltage line, and applying, by the comparator, the sensing signal of a detection success level to the detection line when the voltage of the first power line is lower than the reference voltage; and applying, by the timing controller, a main signal of an activation level to a main line connected to a main power source when the sensing signal of the detection failure level is received, and applying, by the timing controller, the main signal of an inactivation level to the main line when the sensing signal of the detection success level is received, at a second time after the first time.

The method may further include applying, by the main power source, a voltage of a second level higher than the first level to the first power line when the main signal of the activation level is received.

The method may further include receiving, by the pixels, data voltages when the voltage of the second level is applied to the first power line.

The method may further include suspending, by the auxiliary power source, supplying a voltage when the timing controller applies the auxiliary signal of an inactivation level to the auxiliary line, at a third time after the second time.

The method may further include maintaining, by a second power line commonly connected to the pixels, a voltage level from the first time to the third time.

The method may further include maintaining, by the first power line, a voltage lower than the reference voltage when the main power source receives the main signal of the inactivation level, after the second time.

The method may further include maintaining, by a second power line commonly connected to the pixels, a voltage level from the first time to the second time.

In accordance with an embodiment of the present disclosure, there is provided a display device including an auxiliary power source, a main power source, a timing controller, and a comparator. The auxiliary power source is configured to apply a first voltage during a first period of a display period to a power line supplying power to a display panel of the display device. The main power source is configured to apply a second voltage higher than the first voltage to the power line during a second period of the display period. The timing controller is configured to control driving of the display panel, and adjust power applied to the power line based on a control signal. The comparator compares a voltage of the power line with a reference voltage to provide an output to the timing controller indicating whether a short circuit has occurred as the control signal. The timing controller may instruct the main power source to stop applying the second voltage upon receiving the control signal indicating the short circuit has occurred. The timing controller may instruct the main power source to resume applying the second voltage during the second period upon receiving the control signal indicating the short circuit has not occurred.

DETAILED DESCRIPTION

Figure 1:
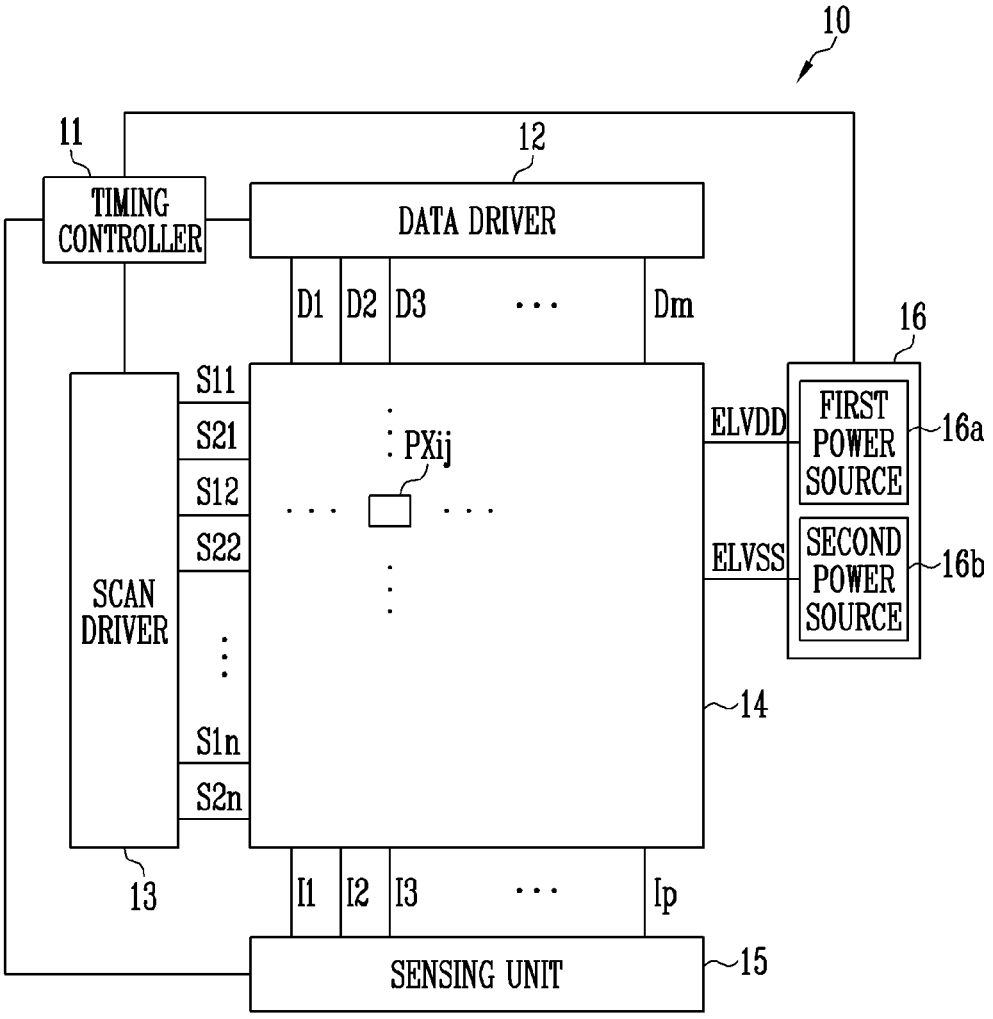
FIG. 1 is a diagram illustrating a display device in accordance with an embodiment of the present disclosure.

Hereinafter, embodiments of the disclosure are described in detail with reference to the accompanying drawings so that those of ordinary skill in the art may practice the present disclosure. The present disclosure may be implemented in various different forms and is not limited to the embodiments described in the present specification.

Identical or similar constituent elements will be designated by the same reference numerals throughout the specification. Therefore, the same reference numerals may be used in different drawings to identify the same or similar elements.

In addition, the size and thickness of each component illustrated in the drawings are shown for better understanding and ease of description, but the present disclosure is not limited thereto. Thicknesses of several portions and regions may be exaggerated for clarity.

In description, the expression "equal" may mean "substantially equal." That is, this may mean equality to a degree to which those of ordinary skill in the art can understand the equality.

FIG. 1 is a diagram illustrating a display device in accordance with an embodiment of the present disclosure.

Referring to FIG. 1, the display device 10 in accordance with the embodiment of the present disclosure includes a timing controller 11 (e.g., a control circuit), a data driver 12 (e.g., a driver circuit), a scan driver 13 (e.g., driver circuit), a pixel unit 14 (e.g., an array of pixels), a sensing unit 15 (e.g., a sensor or sensing circuit), and a power source unit 16 (e.g., a power source or voltage generator).

The timing controller 11 may receive grayscale values and control signals for each image frame from an external processor. The timing controller 11 may render grayscale values to correspond to specifications of the display device 10. For example, the external processor may provide a red grayscale value, a green grayscale value, and a blue grayscale value with respect to each unit dot. However, when the pixel unit 14 has a pentile structure, adjacent unit dots share a pixel, and therefore, pixels may not correspond one-to-one to the respective grayscale values. Accordingly, it may be necessary to render the grayscale values. When pixels correspond one-to-one to the respective grayscale values, it may be unnecessary to render the grayscale values. Rendered grayscale values or non-rendered grayscale values may be provided to the data driver 12. Also, the timing controller 11 may provide the data driver 12, the scan driver 13, the sensing unit 15, or the power source unit 16, with control signals suitable for specifications of the data driver 12, the scan driver 13, the sensing unit 15, or the power source unit 16, for the purpose of displaying frames of image data.

The data driver 12 may generate data voltages to be provided to data lines D1, D2, D3, . . . , and Dm by using grayscale values and control signals. For example, the data driver 12 may sample grayscale values by using a clock signal, and apply data voltages corresponding to the grayscale values to the data lines D1 to Dm in a unit of a pixel row. Here, m may be an integer greater than 0. The pixel row may mean pixels connected to the same scan line.

The scan driver 13 may generate first scan signals to be provided to first scan lines S11, S12, . . . , and S1*n* and second scan signals to be provided to second scan lines S21, S22, . . . , and S2*n*, by receiving a clock signal and a scan start signal from the timing controller 11. Here, n may be an integer greater than 0.

The scan driver 13 may sequentially supply the first scan signals having a pulse of a turn-on level to the first scan lines S11, S12, . . . , and S1*n*. Also, the scan driver 13 may sequentially supply the second scan signals having the pulse of the turn-on level to the second scan lines S21, S22, . . . , and S2*n*.

For example, the scan driver 13 may include a first scan driver connected to the first scan lines S11, S12, . . . , and S1*n* and a second scan driver connected to the second scan lines S21, S22, . . . , and S2*n*. Each of the first scan driver and the second scan driver may include scan stages configured in the form of shift registers. Each of the first scan driver and the second scan driver may generate scan signals in a manner that sequentially transfers a scan start signal in the form of a pulse of a turn-on level to a next scan stage under the control of the clock signal.

In some embodiments, the first scan signals and the second scan signals may be the same. A first scan line and a second scan line, which are connected to each pixel PXij, may be connected to the same node. In an embodiment, the scan driver 13 is not divided into the first scan driver and the second driver, but is configured as a single scan driver.

The sensing unit 15 may supply an initialization voltage to sensing lines I1, I2, I3, . . . , and Ip by receiving a control signal, or receive a sensing signal. For example, the sensing unit 15 may supply the initialization voltage to the sensing lines I1, I2, I3, . . . , and Ip during at least a partial period in a display period. For example, the sensing unit 15 may receive the sensing signal through the sensing lines I1, I2, I3, . . . , and Ip during at least a partial period in a sensing period. Here, p may be an integer greater than 0. For example, the sensing period may occur within the display period. In an embodiment, image data is output to all pixel rows of the pixel unit 14 during the display period.

The sensing unit 15 may include sensing channels connected to the sensing lines I1, I2, I3, . . . , and Ip. For example, the sensing lines I1, I2, I3, . . . , and Ip and the sensing channels may correspond one-to-one to each other.

The pixel unit 14 may include pixels. Each pixel PXij may be connected to a corresponding data line, a corresponding scan line, and a corresponding sensing line. An exemplary structure of the pixel PXij will be described later with reference to FIG. 2.

The power source unit 16 may include a first power source 16*a* and a second power source 16*b*. The first power source 16*a* and the second power source 16*b* may be configured with different integrated chips (ICs), or be integrated in one IC. For example, the first power source 16*a* may be housed on a first IC and the second power source 16*b* may be housed on a second IC or both power sources 16*a* and 16*b* may be housed on a single IC. The first power source 16*a* may be commonly connected to the pixels through a first power line ELVDD. The second power source 16*b* may be commonly connected to the pixels through a second power line ELVSS. The first power source 16*a* may supply a first power voltage through the first power line ELVDD. The second power source 16*b* may supply a second power voltage through the second power line ELVSS. In an embodiment, the first power voltage is higher than the second power voltage in a display period of the pixel unit 14. A current path passing through the first power source 16*a*, the first power line ELVDD, the pixel unit 14, the second power line ELVSS, and the second power source 16*b* may be formed in the display period of the pixel unit 14.

Figure 2:
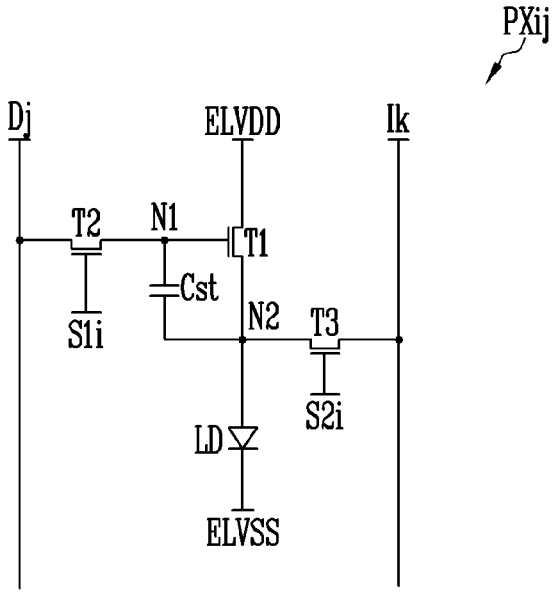
FIG. 2 is a diagram illustrating a pixel in accordance with an embodiment of the present disclosure.
Figure 3:
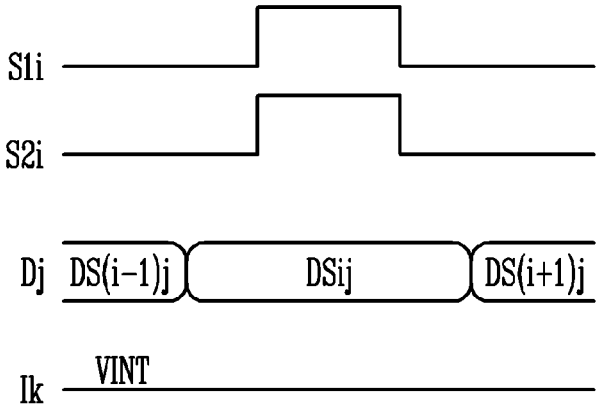
FIG. 3 is a diagram illustrating a driving method of the pixel in accordance with an embodiment of the present disclosure.

FIG. 2 is a diagram illustrating a pixel in accordance with an embodiment of the present disclosure. FIG. 3 is a diagram illustrating a driving method of the pixel in accordance with an embodiment of the present disclosure.

Referring to FIG. 2, the pixel PXij includes transistors T1, T2, and T3, a storage capacitor Cst, and a light emitting diode LD.

The transistors T1, T2, and T3 may be implemented with an N-type transistor. In another embodiment, the transistors T1, T2, and T3 may be implemented with a P-type transistor. In another embodiment, the transistors T1, T2, and T3 may be implemented with a combination of the N-type and P-type transistors. The P-type transistor generally refers to a transistor in which an amount of current increases when a voltage difference between a gate electrode and a source electrode increases in a negative direction. The N-type transistor generally refers to a transistor in which an amount of current increases when a voltage difference between a gate electrode and a source electrode increases in a positive direction. The transistor may be configured in various forms such as a Thin Film Transistor (TFT), a Field Effect Transistor (FET), and a Bipolar Junction Transistor (BJT).

A gate electrode of a first transistor T1 is connected to a first node N1, a first electrode of the first transistor T1 is connected to a first power line ELVDD, and a second electrode of the first transistor T1 is connected to a second node N2. The first transistor T1 may be referred to as a driving transistor.

A gate electrode of a second transistor T2 is connected to a first scan line S1*i*, a first electrode of the second transistor T2 is connected to a data line Dj, and a second electrode of the second transistor T2 is connected to the first node N1. The second transistor T2 may be referred to as a scanning transistor.

A gate electrode of a third transistor T3 is connected to a second scan line S2*i*, a first electrode of the third transistor T3 is connected to the second node N2, and a second electrode of the third transistor T3 is connected to a sensing line Ik. The third transistor T3 may be referred to as a sensing transistor.

A first electrode of the storage capacitor Cst is connected to the first node N1, and a second electrode of the storage capacitor Cst is connected to the second node N2.

An anode of the light emitting diode LD is connected to the second node N2, and a cathode of the light emitting diode LD is connected to a second power line ELVSS. The light emitting diode LD may be implemented by an organic light emitting diode, an inorganic light emitting diode, or a quantum dot/well light emitting diode. Also, the light emitting diode LD may be implemented with a plurality of light emitting diodes connected in series, parallel, or series/parallel.

In a display period, a first power voltage of the first power line ELVDD is higher than a second power voltage of the second power line ELVSS. However, a voltage of the second power line ELVSS may be set higher than that of the first power line ELVDD in a special situation such as a situation in which emission of the light emitting diode LD is to be prevented.

Referring to FIG. 3, there are illustrated exemplary waveforms of signals applied to the scan lines S1*i* and S2*i*, the data line Dj, and the sensing line Ik, which are connected to the pixel PXij, during a horizontal period corresponding to the scan lines S1*i* and S2*i*. Here, k may be an integer greater than 0. One frame period of a display period may include a plurality of horizontal periods corresponding to pixel rows. For example, image data may be output to one of the pixel rows during one of the horizontal periods.

In an embodiment, an initialization voltage VINT is applied to the sensing line Ik.

Data voltages DS(i−1)j, DSij, and DS(i+1)j may be sequentially applied to the data line Dj in a horizontal period unit. A first scan signal of a turn-on level (logic high level) may be applied to the first scan line S1*i* in a corresponding horizontal period. In addition, a second scan signal of the turn-on level may be applied to the second scan line S2*i* in synchronization with the first scan line S1*i*. In another embodiment, during the display period, the second scan line S2*i* may be in a state in which the second scan signal of the turn-on level is always applied to the second scan line S2*i*.

For example, when scan signals of the turn-on level are applied to the first scan line S1*i* and the second scan line S2*i*, the second transistor T2 and the third transistor T3 may be in a turn-on state. Therefore, a voltage corresponding to a difference between the data voltage DSij and the initialization voltage VINT is written in the storage capacitor Cst of the pixel PXij.

In the pixel PXij, an amount of driving current flowing through a driving path connecting the first power line ELVDD, the first transistor T1, the light emitting diode LD, and the second power line ELVSS is determined according to a voltage difference between the gate electrode and a source electrode of the first transistor T1. An emission luminance of the light emitting diode LD may be determined according to the amount of driving current.

Subsequently, when the scan signal of a turn-off level (logic low level) is applied to the first scan line S1*i* and the second scan line S2*i*, the second transistor T2 and the third transistor T3 may be in a turn-off state. Therefore, the voltage difference between the gate electrode and the source electrode of the first transistor T1 may be maintained by the storage capacitor Cst, regardless of a change in voltage of the data line Dj, and the emission luminance of the light emitting diode LD may be maintained.

The structure and driving method of the pixel PXij described with reference to FIGS. 1 to 3 corresponds to one embodiment. Embodiments shown in FIGS. 4 to 8, which will be described later, may be applied to the structure and driving method of any pixel different from that illustrated in FIG. 2.

Figure 4:
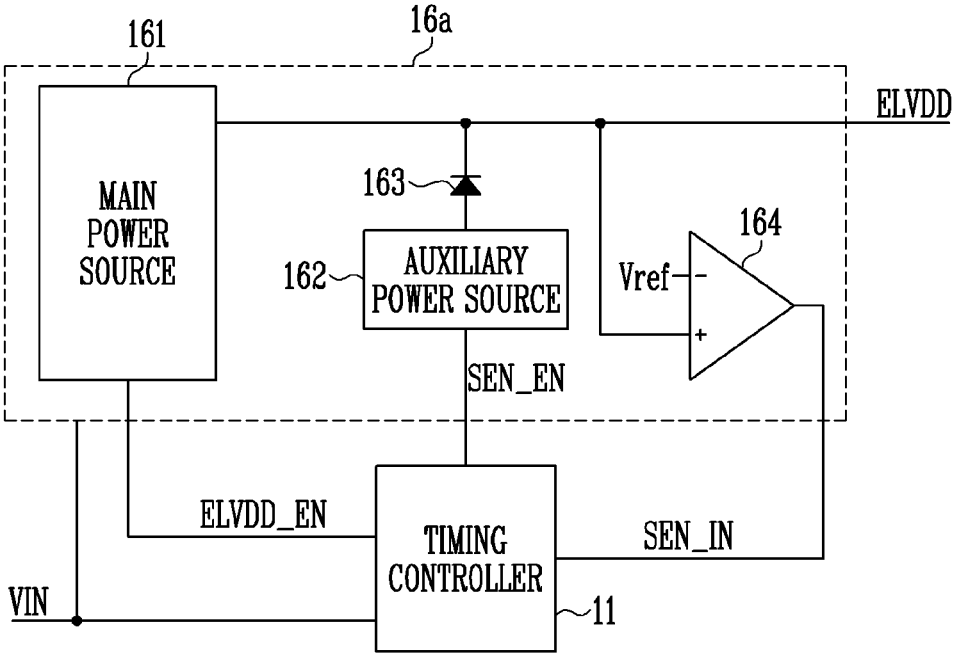
FIG. 4 is a diagram illustrating a first power source and a timing controller in accordance with an embodiment of the present disclosure.

FIG. 4 is a diagram illustrating a first power source and a timing controller in accordance with an embodiment of the present disclosure.

Referring to FIG. 4, the first power source 16*a* in accordance with the embodiment of the present disclosure includes a main power source 161, an auxiliary power source 162, a rectifier 163 (e.g., a rectifier circuit), and a comparator 164 (e.g., a comparator circuit). In an embodiment, the comparator 164 is implemented by an operational amplifier. In the embodiment, the timing controller 11 is connected to the first power source 16*a* through a main line ELVDD_EN, an auxiliary line SEN_EN, and a detection line SEN_IN.

The first power source 16*a* and the timing controller 11 may operate by being supplied with power from an input power source VIN.

In an embodiment, the main power source 161 is connected to the first power line ELVDD and the main line ELVDD_EN. For example, the main power source 161 may be configured as a DC-DC converter, a low dropout regulator, or another kind of regulator. When a main signal of an activation level (e.g., a first logic level) is received through the main line ELVDD_EN, the main power source 161 changes a voltage of the input power source VIN to a voltage of a second level. The main power source 161 may apply the voltage of the second level to the first power line ELVDD. In an embodiment, the voltage of the second level is a first power voltage required in the pixel PXij during a display period. When the main signal of an inactivation level (e.g., a second logic level different from the first logic level) is received through the main line ELVDD_EN, the main power source 161 may suspend the supply of the voltage of the second level.

The auxiliary power source 162 is connected to the auxiliary line SEN_EN. For example, the auxiliary power source 162 may be configured as a DC-DC converter, a low dropout regulator, or another kind of regulator. The auxiliary power source 162 may be housed on an IC separate from the main power source 161. When an auxiliary signal of an activation level is received through the auxiliary line SEN_EN from the timing controller 11, the auxiliary power source 162 changes the voltage of the input power source VIN to a voltage of a first level. In an embodiment, the voltage of the first level is lower than the voltage of the second level. When the auxiliary signal of an inactivation level is received through the auxiliary line SEN_EN, the auxiliary power source 162 may suspend the supply of the voltage of the first level.

A first terminal of the rectifier 163 is connected to the auxiliary power source 162, and a second terminal of the rectifier 163 is connected to the first power line ELVDD. For example, the rectifier 163 may be a diode. The first terminal may be an anode of the diode, and the second terminal may be a cathode of the diode. The rectifier 163 allows a current flowing from the auxiliary power source 162 to flow to the first power line ELVDD, and does not allow a current to flow from the first power line ELVDD to the auxiliary power source 162. The rectifier 163 is not necessarily configured as the diode, and various other circuits may be used. For example, the rectifier 163 may be implemented by a diode connected transistor.

A first input terminal of the comparator 164 is connected to the first power line ELVDD, and an output terminal of the comparator 164 is connected to the detection line SEN_IN. A second input terminal of the comparator 164 is connected to a reference voltage line Vref. For example, when a voltage of the first power line ELVDD is higher than a reference voltage of the reference voltage line Vref, the comparator 164 may apply a sensing signal of a detection failure level to the detection line SEN_IN. Detection failure may mean that no short-circuit state has been detected. For example, when the voltage of the first power line ELVDD is lower than the reference voltage of the reference voltage line Vref, the comparator 164 may apply the sensing signal of a detection success level to the detection line SEN_IN. Detection success may mean that a short-circuit state has been detected. In an embodiment, the magnitude of the reference voltage is set to about 90% of the voltage of the first level.

In an embodiment, it is assumed that the first input terminal of the comparator 164 is a non-inverting terminal and the second input terminal of the comparator 164 is configured with an amplifier as an inverting terminal. In another embodiment, when the first input terminal of the comparator 164 is configured as the inverting terminal and the second input terminal of the comparator 164 is configured as the non-inverting terminal, the reference of detection failure and detection success may be reversed.

Figure 5:
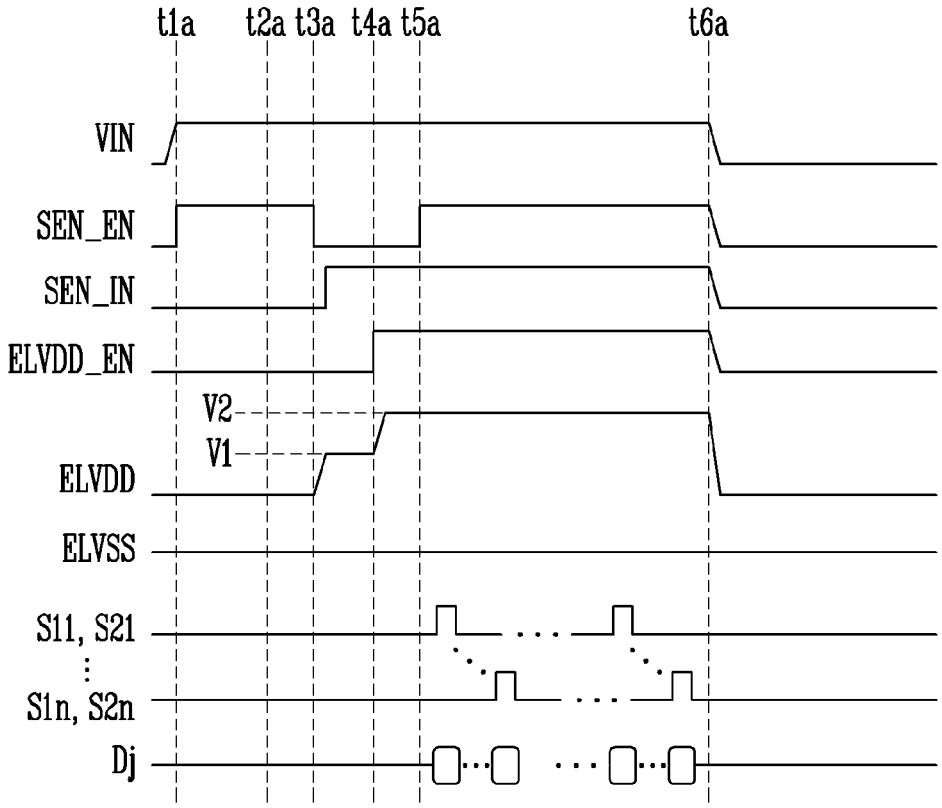
FIG. 5 is a diagram illustrating a driving method when any short-circuit state is not detected in accordance with an embodiment of the present disclosure.

FIG. 5 is a diagram illustrating a driving method when no short-circuit state is detected in accordance with an embodiment of the present disclosure.

First, the power of the input power source VIN is supplied. For example, the power may be supplied to the timing controller 11. The voltage of the input power source VIN may be changed from a logic low level to a logic high level for the power to be supplied. Accordingly, the display device 10 may be powered on.

At a time t1*a*, a Micro Control Unit (MCU) in the timing controller 11 may start loading. In an embodiment, the MCU is a microcontroller or a microprocessor and performs one of more functions of the timing controller. Also, at the time t1*a*, the timing controller 11 applies an auxiliary signal of an inactivation level (e.g., a logic high level) to the auxiliary line SEN_EN.

At a time t2*a*, the loading of the MCU in the timing controller 11 completes.

At a time t3*a* after the time t2*a*, the timing controller 11 applies the auxiliary signal of an activation level (e.g., a logic low level) to the auxiliary line SEN_EN. Accordingly, the auxiliary power source 162 may apply a voltage V1 of a first level to the first terminal of the rectifier 163. Since the voltage of the first power line ELVDD is lower than the voltage V1 of the first level, a current is supplied from the auxiliary power source 162 to the first power line ELVDD. For example, the voltage V1 of the first level may be 10V, and current of a few milliamps (mA) may flow through the first power line ELVDD. In a state in which any short circuit does not occur in the pixel unit 14, etc., the first power line ELVDD is charged with the voltage V1 of the first level.

When the voltage of the first power line ELVDD is higher than the reference voltage of the reference voltage line Vref, the comparator 164 may apply a sensing signal of a detection failure level (e.g., a logic high level) to the detection line SEN_IN. The sensing signal informs the timing controller 11 whether a short circuit has occurred. The sensing signal of the detection failure level may indicate that no short circuit has occurred.

At a time t4*a* after the time t3*a*, when the sensing signal of the detection failure level is received, the timing controller 11 applies a main signal of an activation level (e.g., a logic high level) to the main line ELVDD_EN. When the main signal of the activation level is received, the main power source 161 applies a voltage V2 of a second level higher than the first level to the first power line ELVDD.

Since the voltage of the first power line ELVDD is increased to the voltage V2 of the second level via the voltage V1 of the first level in two steps, an inrush current which may be generated in the input power source VIN can be prevented.

At a time t5*a* after the time t4*a*, when the timing controller 11 applies the auxiliary signal of the inactivation level (e.g., the logic high level) to the auxiliary line SEN_EN, the auxiliary power source 162 suspends supplying a voltage to the first power line ELVDD. For example, the time t5*a* may be a time before a display period is started. Meanwhile, the time t5*a* may be a time after the display period is started. At the time t5*a*, since the main power source 161 is in a state in which the main power source 161 stably supplies the voltage V2 of the second level, the voltage of the first power line ELVDD may be maintained at the second level even when the voltage supply of the auxiliary power source 162 is suspended. Accordingly, unnecessary power waste of the auxiliary power source 162 can be prevented.

When the voltage V2 of the second level is applied to the first power line ELVDD, the pixels of the pixel unit 14 may receive data voltages. For example, data voltages may be generated by the data driver 12 from power supplied to it from the timing controller 11 based on voltage V2. That is, when the voltage V2 of the second level is applied to the first power line ELVDD, the display period including a plurality of frame periods may be started. In each frame period, a scan signal of a turn-on level may be sequentially applied to the scan lines S11, S21, . . . , S1*n*, and S2*n*, and data voltages corresponding to each scan signal may be applied to the data line Dj and other data lines.

In an embodiment, the second power line ELVSS maintains a constant voltage level from the time t3*a* to the time t5*a*. The second power line ELVSS may maintain the voltage level even before the time t3*a* and after the time t5*a*. For example, the second power line ELVSS may maintain a voltage of a ground level.

At a time t6*a* after the time t5*a*, the supply of the voltage of the input power source VIN is suspended. The voltage of the input power source VIN may change from the logic high level to the logic low level. Accordingly, the display device 10 may be powered off.

Figure 6:
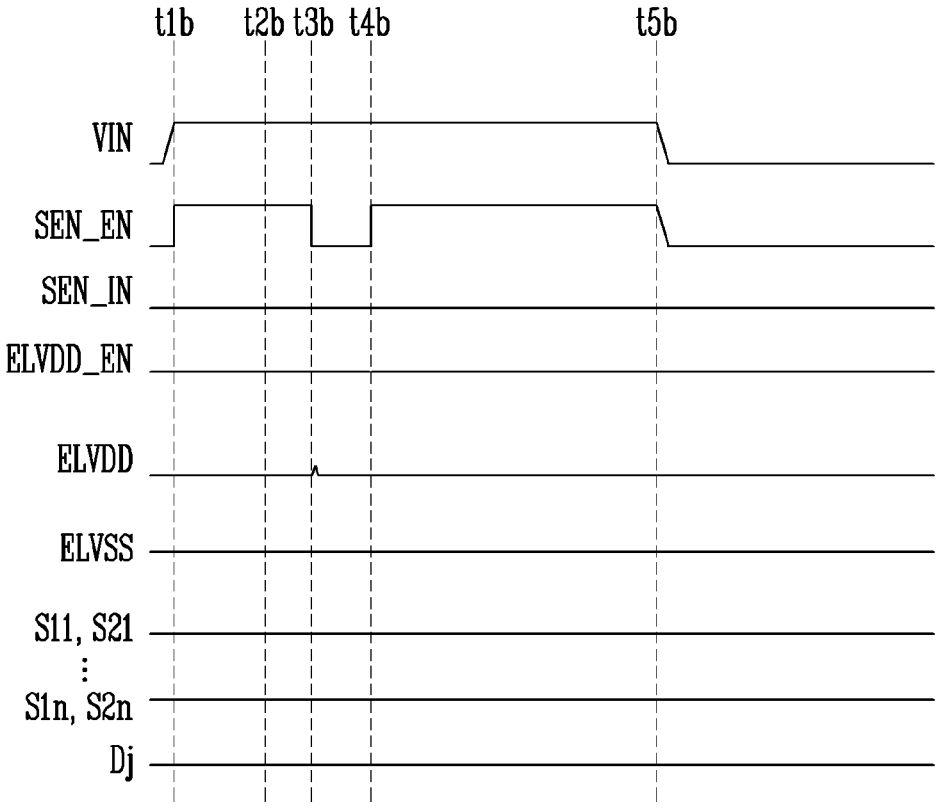
FIG. 6 is a diagram illustrating a driving method when a short-circuit state is detected in accordance with an embodiment of the present disclosure.

FIG. 6 is a diagram illustrating a driving method when a short-circuit state is detected in accordance with an embodiment of the present disclosure.

First, the power of the input power source VIN is supplied. The voltage of the input power source VIN is changed from a logic low level to a logic high level. Accordingly, the display device 10 is powered on.

At a time t1*b*, the MCU in the timing controller 11 starts loading. Also, at the time t1*b*, the timing controller 11 applies an auxiliary signal of an inactivation level (e.g., a logic high level) to the auxiliary line SEN_EN.

At a time t2*b*, the loading of the MCU in the timing controller 11 is completed.

At a time t3*b* after the time t2*b*, the timing controller 11 applies the auxiliary signal of an activation level (e.g., a logic low level) to the auxiliary line SEN_EN. Accordingly, the auxiliary power source 162 applies a voltage V1 of a first level to the first terminal of the rectifier 163. Since the voltage of the first power line ELVDD is lower than the voltage V1 of the first level, a current is supplied from the auxiliary power source 162 to the first power line ELVDD. For example, the voltage V1 of the first level may be 10V, and a current of a few mA may flow through to the first power line ELVDD. In a state in which a short circuit occurs in the pixel circuit 14, etc., a current leaked to a short-circuited portion, and the first power line ELVDD is not charged with the voltage V1 of the first level.

When the voltage of the first power line ELVDD is lower than the reference voltage of the reference voltage line Vref, the comparator 164 applies a sensing signal of a detection success level (e.g., a logic low level) to the detection line SEN_IN. The sensing signal of the detection success level informs the timing controller 11 that a short circuit has occurred.

At a time t4*b* after the time t3*b*, when the sensing signal of the detection success level is received, the timing controller 11 applies a main signal of an inactivation level (e.g., a logic low level) to the main line ELVDD_EN or maintains the main signal of the inactivation level. When the main signal of the inactivation level is received, the first power line ELVDD maintains a voltage lower than the reference voltage. For example, the main power source 161 may supply no voltage to the first power line ELVDD or suspends supplying a voltage. Thus, the voltage commonly applied to the pixels to power the pixels is not provided for a period of time after a short circuit is detected. Accordingly, an over-current can be prevented from flowing through the short-circuited portion.

Also, at the time t4*b*, when the sensing signal of the detection success level is received, the timing controller 11 applies the auxiliary signal of the inactivation level (e.g., the logic high level) to the auxiliary line SEN_EN. In an embodiment, an interval between the time t3*b* at which the auxiliary signal of the activation level is applied to the auxiliary line SEN_EN and the time t4*b* at which the auxiliary signal of the inactivation level is applied to the auxiliary line SEN_EN is smaller than that between the time t3*a* and the time t5*a*, which are shown in FIG. 5. That is, when a short-circuit state is detected, a period in which an invalid current flows through the first power line may be minimized.

Like the case shown in FIG. 6, when the short-circuit state is detected, the pixel unit 14 does not display any image.

In an embodiment, the second power line ELVSS maintains a voltage level from the time t3*b* to the time t4*b*. The second power line ELVSS may maintain the voltage level even before the time t3*b* and after the time t4*b*. For example, the second power line ELVSS may maintain a voltage of a ground level.

At a time t5*b* after the time t4*b*, the supply of the voltage of the input power source VIN is suspended. The voltage of the input power source VIN may change from the logic high level to the logic low level when the supply of the voltage is suspended. Accordingly, the display device 10 may be powered off.

Figure 7:
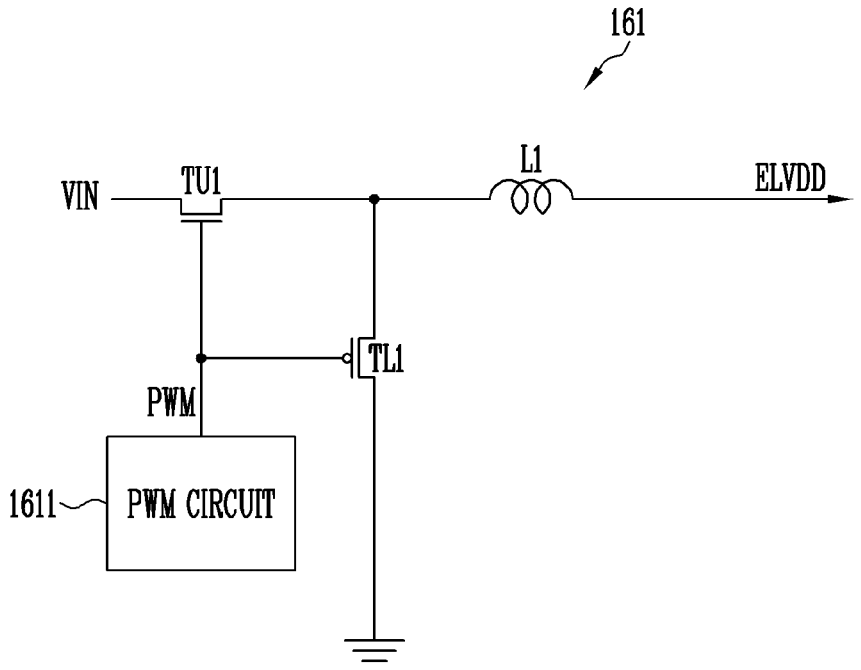
FIG. 7 is a diagram illustrating a main power source in accordance with an embodiment of the present disclosure.

FIG. 7 is a diagram illustrating a main power source in accordance with an embodiment of the present disclosure.

Referring to FIG. 7, the main power source 161 is a buck converter. The voltage level of the input power source VIN is higher than the voltage V2 of the second level. For example, the voltage level of the input power source VIN may be 30V, and the voltage V2 of the second level may be 24V. For example, the main power source 161 may include transistors TU1 and TL1, an inductor L1, and a pulse width modulation (PWM) circuit 1611.

The PWM circuit 1611 may generate a PWM signal PWM. The PWM signal PWM may have an on/off duty ratio, and alternately turn on/off the transistors TL1 and TU1. For example, the PWM signal PWM may include a signal with pulses having a certain duty ratio. The PWM signal PWM may be provided to gate terminals of transistors TL1 and TU1. In an embodiment, the transistors TL1 and TU1 are complementary transistors.

First, when the transistor TU1 is turned on and the transistor TL1 is turned off, energy is stored in the inductor L1 while a current is supplied from the input power source VIN to the first power line ELVDD. Next, when the transistor TU1 is turned off and the transistor TL1 is turned on, a current is supplied to the first power line ELVDD, based on the energy stored in the inductor L1. Since the input power source VIN is separated from the first power line ELVDD, a current supplied from the inductor L1 is gradually decreased. The voltage of the first power line ELVDD may be decreased as the duty ratio of the PWM signal PWM is decreased.

For example, when the main signal of the inactivation level is applied to the main line ELVDD_EN, the PWM circuit 1611 may minimize the duty ratio of the PWM signal PWM (e.g., 0). For example, when the main signal of the activation level is applied to the main line ELVDD_EN, the PWM circuit 1611 may tune the duty ratio of the PWM signal PWM such that the voltage V2 of the second level is output.

Figure 8:
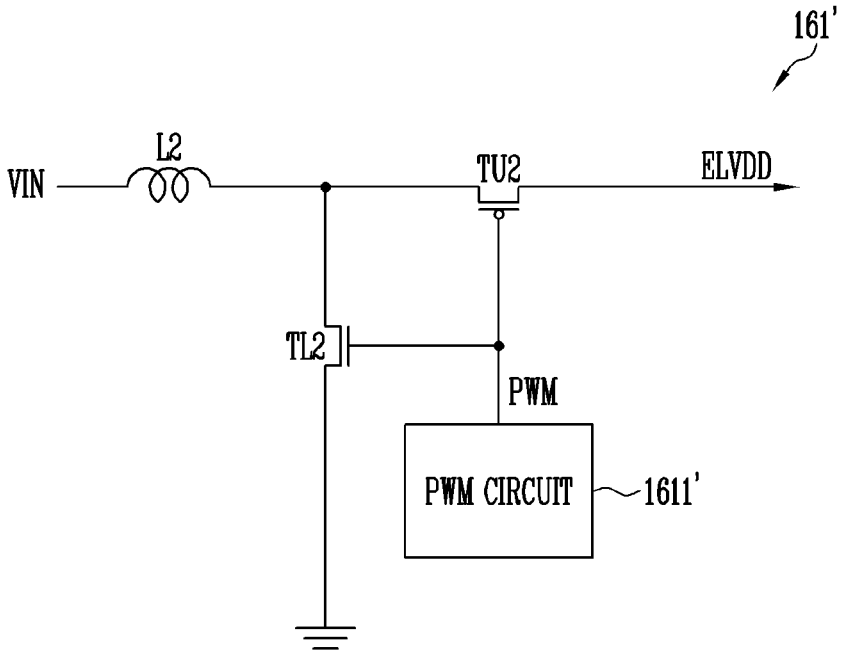
FIG. 8 is a diagram illustrating a main power source in accordance with another embodiment of the present disclosure.

FIG. 8 is a diagram illustrating a main power source in accordance with an embodiment of the present disclosure.

Referring to FIG. 8, the main power source 161' may be a boost converter. The main power source 161 of FIG. 4 may be replaced with the main power source 161' of FIG. 8. In an embodiment, the voltage level of the input power source VIN is lower than the voltage V2 of the second level. The main power source 161' includes transistors TU2 and TL2, an inductor L2, and a PWM circuit 1611'.

The PWM circuit 1611' is configured to generate a PWM signal PWM. The PWM signal PWM may have an on/off duty ratio, and alternately turn on/off the transistors TL2 and TU2. For example, the PWM signal PWM may include a plurality of pulses with a certain duty ratio. The PWM signal may be applied to gate terminals of the transistors TL2 and TU2.

First, when the transistor TL2 is turned on and the transistor TU2 is turned off, energy is stored in the inductor L2 while a current of the inductor L2 is increased. Next, when the transistor TL2 is turned off and the transistor TU2 is turned on, a voltage amplified by adding a current output from the input power source VIN and a current output from the inductor L2 is applied to the first power line ELVDD. The voltage of the first power line ELVDD may be increased as the duty ratio of the PWM signal PWM is increased.

For example, when the main signal of the inactivation level is applied to the main line ELVDD_EN, the PWM circuit 1611' may minimize the duty ratio of the PWM signal PWM (e.g., 0). For example, when the main signal of the activation level is applied to the main line ELVDD_EN, the PWM circuit 1611' may tune the duty ratio of the PWM signal PWM such that the voltage V2 of the second level is output.

In an embodiment, a power source for a display device includes a main power source, an auxiliary power source, a rectifier, and a comparator. The main power source is connected to a power line of pixels of the display device and a main line of a timing controller of the display device. The auxiliary power source is connected to an auxiliary line that is connected to the timing controller. The rectifier directs current in one direction from the auxiliary power source to the power line. The comparator compares a voltage of the power line with a reference voltage to provide an output to the timing controller indicating whether a short circuit has occurred. The timing controller can instruct the main power source to only provide power to the main line when no short circuit is occurring.

In the display device and the driving method thereof in accordance with an embodiment of the present disclosure, a minute short-circuit state can be detected.

In the display device and the driving method thereof in accordance with the present disclosure, an inrush current which may be generated in the input power source can be prevented.

Example embodiments have been disclosed herein, and although specific terms are employed, they are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of ordinary skill in the art that various changes in form and details may be made without departing from the spirit and scope of the present disclosure as set forth in the following claims.

What is claimed is:

1. A display device comprising:

a first power source;

a timing controller connected to the first power source through a main line, an auxiliary line, and a detection line; and a plurality of pixels commonly connected to the first power source through a first power line, wherein the first power source comprises:

a main power source connected to the first power line and the main line;

an auxiliary power source connected to the auxiliary line;

a rectifier connected between the auxiliary power source and the first power line; and a comparator comparing a voltage of the first power line and providing its output to the detection line.

2. The display device of claim 1, wherein the comparator has an input terminal connected to a reference voltage line.

3. The display device of claim 2, wherein, at a first time, when the timing controller applies an auxiliary signal of an activation level to the auxiliary line, the auxiliary power source applies a voltage of a first level to the rectifier.

4. The display device of claim 3, wherein, when a voltage of the first power line is higher than a reference voltage of the reference voltage line, the comparator applies a sensing signal of a detection failure level to the detection line.

5. The display device of claim 4, wherein, at a second time after the first time, when the sensing signal of the detection failure level is received, the timing controller applies a main signal of an activation level to the main line.

6. The display device of claim 5, wherein, when the main signal of the activation level is received, the main power source applies a voltage of a second level higher than the first level to the first power line.

7. The display device of claim 6, wherein, when the voltage of the second level is applied to the first power line, the pixels receive data voltages.

8. The display device of claim 7, wherein, at a third time after the second time, when the timing controller applies the auxiliary signal of an inactivation level to the auxiliary line, the auxiliary power source suspends supplying a voltage.

9. The display device of claim 8, further comprising a second power source, wherein the pixels are commonly connected to the second power source through a second power line, and wherein the second power line maintains a voltage level from the first time to the third time.

10. The display device of claim 3, wherein, when the voltage of the first power line is lower than a reference voltage of the reference voltage line, the comparator applies a sensing signal of a detection success level to the detection line.

11. The display device of claim 10, wherein, at a second time after the first time, when the sensing signal of the detection success level is received, the timing controller applies a main signal of an inactivation level to the main line.

12. The display device of claim 11, wherein, at the second time, when the sensing signal of the detection success level is received, the timing controller applies an auxiliary signal of an inactivation level to the auxiliary line.

13. The display device of claim 12, wherein, after the second time, when the main power source receives the main signal of the inactivation level, the first power line maintains a voltage lower than the reference voltage.

14. A method for driving a display device including pixels commonly connected to a first power line, the method comprising:

applying, by a timing controller, an auxiliary signal of an activation level to an auxiliary line connected to an auxiliary power source, at a first time;

applying, by the auxiliary power source, a voltage of a first level to the first power line through a rectifier;

applying, by comparator, a sensing signal of a detection failure level to a detection line when a voltage of the first power line is higher than a reference voltage of a reference voltage line, and applying, by the comparator, the sensing signal of a detection success level to the detection line when the voltage of the first power line is lower than the reference voltage; and applying, by the timing controller, a main signal of an activation level to a main line connected to a main power source when the sensing signal of the detection failure level is received, and applying, by the timing controller, the main signal of an inactivation level to the main line when the sensing signal of the detection success level is received, at a second time after the first time.

15. The method of claim 14, further comprising applying, by the main power source, a voltage of a second level higher than the first level to the first power line when the main signal of the activation level is received.

16. The method of claim 15, further comprising receiving, by the pixels, data voltages when the voltage of the second level is applied to the first power line.

17. The method of claim 16, further comprising suspending, by the auxiliary power source, supplying a voltage when the timing controller applies the auxiliary signal of an inactivation level to the auxiliary line, at a third time after the second time.

18. The method of claim 17, further comprising maintaining, by a second power line commonly connected to the pixels, a voltage level from the first time to the third time.

19. The method of claim 14, further comprising maintaining, by the first power line, a voltage lower than the reference voltage when the main power source receives the main signal of the inactivation level, after the second time.

20. The method of claim 19, further comprising maintaining, by a second power line commonly connected to the pixels, a voltage level from the first time to the second time.

* * * * *